United States Patent [19]

Polster et al.

[11] Patent Number: 4,836,168

[45] Date of Patent: Jun. 6, 1989

[54] LIQUID COOLING SYSTEM

[75] Inventors: Michael Polster, Wiesbaden; Ortwin Schamber, Klein-Gerau, both of Fed. Rep. of Germany

[73] Assignee: General Motors Corporation, Detroit, Mich.

[21] Appl. No.: 172,872

[22] Filed: Mar. 25, 1988

[30] Foreign Application Priority Data

Apr. 14, 1987 [DE] Fed. Rep. of Germany ..... 3712686

[51] Int. Cl.[4] ..... F01P 11/02

[52] U.S. Cl. ..... 123/41.5; 123/41.15; 123/41.54; 165/104.32; 138/30

[58] Field of Search ..... 123/41.5, 41.54, 41.15; 165/104.32; 138/30

[56] References Cited

U.S. PATENT DOCUMENTS

| | | | |
|---|---|---|---|
| Re. 26,765 | 1/1970 | Holmes | 123/41.5 |
| 381,731 | 4/1888 | Walker | 138/30 |
| 3,238,932 | 3/1966 | Simpson | 123/41.5 |
| 3,306,349 | 2/1967 | Holmes | 123/41.5 |
| 3,368,405 | 2/1968 | Christian | 123/41.15 |

FOREIGN PATENT DOCUMENTS 136280 6/1979 German Democratic Rep. .

*Primary Examiner*—Albert W. Davis, Jr.
*Attorney, Agent, or Firm*—R. L. Phillips

[57] ABSTRACT

In a liquid cooling system for an internal combustion engine, an expansion tank which is of a design comparable to that of the expansion tank of a domestic heating system is provided on the engine block with a jacket so that an expansion tank located at the highest point of the cooling system becomes unnecessary. A simple filler neck with a cap having a pressure relief valve and a vacuum valve is provided on the cooler for refilling cooling liquid.

4 Claims, 1 Drawing Sheet

LIQUID COOLING SYSTEM

TECHNICAL FIELD

The present invention pertains to a liquid cooling system for an internal combustion engine in which cooling liquid is circulated in a closed circuit from an engine block with a jacket through a radiator and which has an expansion device for equalizing variations in volume arising as a result of thermal expansion. Such a liquid cooling system is described, e.g., in DDR-PS No. 136,280.

BACKGROUND OF THE INVENTION

An expansion tank, which is able to equalize the fluctuations in volume caused by thermal expansion in the cooling system by varying the filling level, is normally provided as an expansion device at the highest point in a cooling system such as that currently commonly used in motor vehicles. Furthermore, the expansion tank proper normally neither contains nor is connected via a pipe to an expansion chamber which is able to take up or release liquid volumes during minor pressure fluctuations. Because of the latter, the normal pressure relief valve or vacuum valve is prevented from operating during normal operation, which is said to reduce the mechanical stress on the cooling system.

Moreover, the prior art cooling systems commonly used in motor vehicles are expensive. In particular, the mounting of the expansion tank especially commands high costs because it requires a holder in the motor vehicle and tubings must be installed. In addition, the expansion chamber also proposed in the above-mentioned DDR-PS No. 136,280 causes an additional increase in the cost of the cooling system. And the fact that the liquid level in the expansion tank is subject to considerable fluctuations, which makes monitoring of the filling level difficult, is functionally disadvantageous.

SUMMARY OF THE PRESENT INVENTION

An object of the present invention is to provide a cooling system of the type indicated in the introduction such that it can be manufactured at the lowest possible cost and the fluctuations in its filler neck are as small as possible.

This task is accomplished according to the present invention by the expansion device being exclusively formed by an expansion vessel that has a liquid chamber which is defined by a flexible diaphragm and permanently communicates with the cooling system.

According to the present invention, the cooling system for an internal combustion engine is similar to a domestic heating system. An expansion tank with a fluctuating liquid level located above the radiator is completely abandoned according to the present invention. It is replaced by an expansion vessel of simple design, which corresponds to an expansion vessel as used in heating systems, and it is disposed in any point of the cooling system. This simplifies the design of the cooling system very substantially. Furthermore, the expansion vessel provides for an essentially constant filling level in the radiator, so that the level monitoring is simpler than in a system in which the liquid level fluctuates during normal operation.

According to an embodiment of the expansion tank which is of especially simple design, the expansion tank is made hemispherical and a diaphragm between the hemispherical body and a circular bottom is inserted in a sealing relationship with the liquid chamber then provided between the diaphragm and the bottom. In the case of an increase in volume in the cooling system, the expansion tank is able to take up this volume without any appreciable pressure rise by the space between the diaphragm and the hemispherical body having an opening which connects it to the atmosphere. As a result, the liquid level in the filler neck is stabilized.

Furthermore, tubings or a separate holder for the expansion tank are made unnecessary by the expansion tank being arranged directly on the jacketed engine block.

And since the cooling system according to the present invention does not require an expansion tank at the highest point of the system, a filler neck with a cap having a vacuum valve and a pressure relief valve can be provided at the highest point of the radiator. This further simplifies the system. Furthermore, the filler neck is arranged where it is most likely to be expected to be during refilling.

Moreover, automatic monitoring of the liquid level in the cooling system may be achieved in an especially simple manner by a conventional liquid level monitoring unit provided in the filler neck.

These and other objects, advantages and features of the present invention will become more apparent from the following description and drawings in which:

DETAILED DESCRIPTION OF PREFERRED EMBODIMENT

Figure 1:
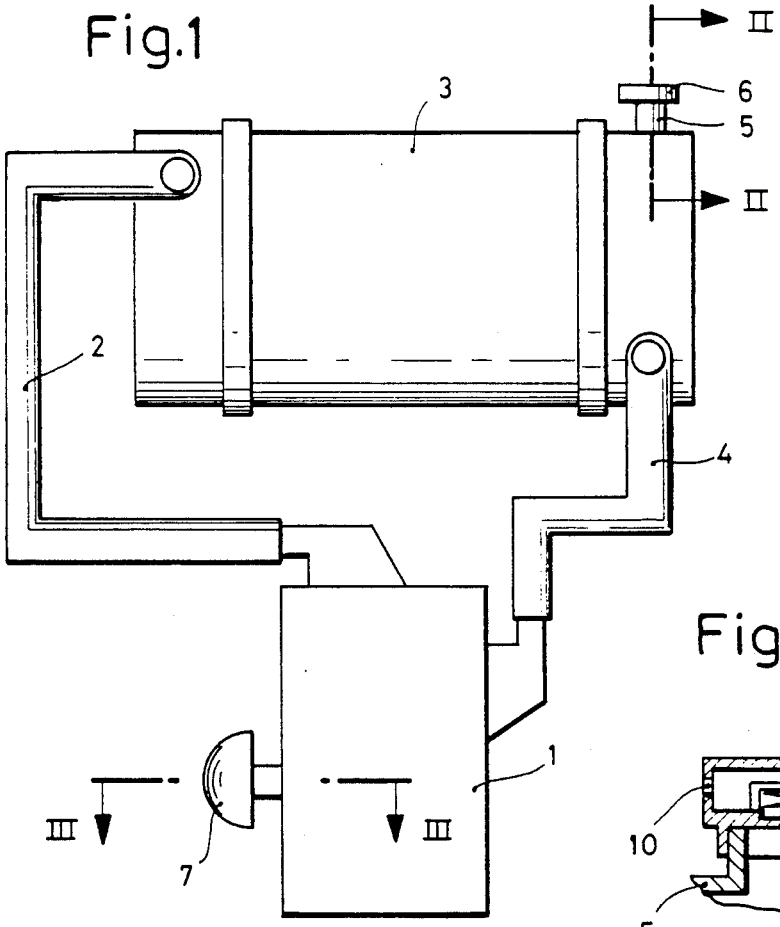
FIG. 1 shows a schematic view of the presently preferred embodiment of the liquid cooling system according to the present invention.

FIG. 1 schematically shows an engine block 1 with a jacket from which cooling liquid flows into a radiator 3 via a feed pipe 2 and back from the radiator into the engine block 1 via a return pipe 4. A filler neck 5 which is closed with a cap 6, is disposed at the highest point of the radiator 3.

An expansion vessel 7 which permanently communicates with the cooling liquid of the cooling system is flanged to the engine block 1.

Figure 2:
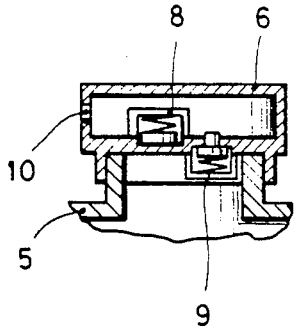
FIG. 2 shows a vertical section through a filler neck of the cooling system along the line 2—2 in FIG. 1.

FIG. 2 shows the design of the filler neck 5 and the cap 6 with which it is closed. A pressure relief valve 8 and a vacuum valve 9 are disposed in this cap 6. The cooling system will thus be connected to the atmosphere via an opening 10 in the cap 6 in the case of undesirably high overpressure or vacuum, so that pressure equalization can take place. A liquid level monitoring unit, which can be disposed in the filler neck 5 to automatically monitor the liquid lelvel, is not shown.

Figure 3:
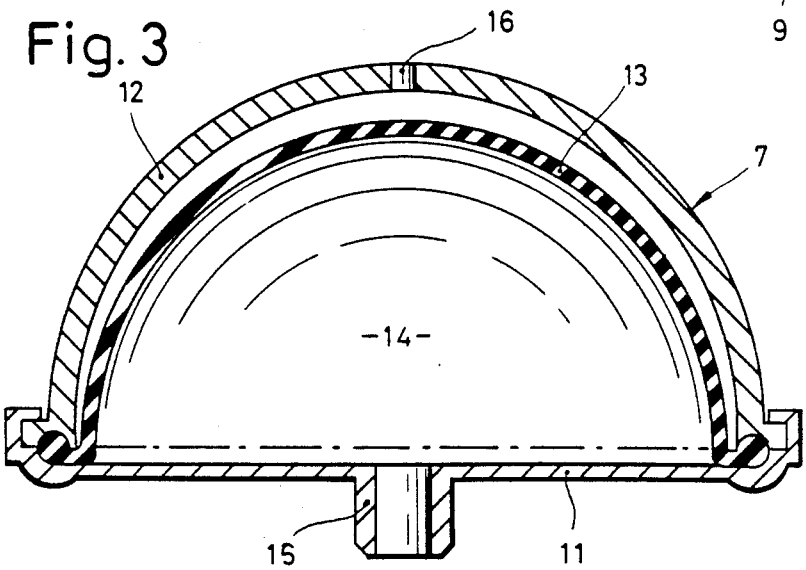
FIG. 3 shows a vertical section through an expansion tank along the line 3—3 in FIG. 1.

The expansion vessel 7 shown on a larger scale in FIG. 3 essentially consists of a circular bottom 11, a hemispherical body 12 and a flexible diaphragm 13 inserted in sealing relationship between the bottom 11 and the hemispherical body 12. The diaphragm 13 is shown by solid lines in the position which it assumes in the operating or pressurized state. In the pressureless state, the diaphragm 13 lies on the bottom 11, which is shown by the dash-dotted line. A liquid chamber 14, which is permanently connected to the cooling system via a pipe 15, is formed between the diaphragm 13 and the bottom 11. To ensure the easiest possible expansion of the diaphragm 13 in the case of an increase in volume of the cooling liquid, an aperture 16 is provided in the hemispherical body 12, so that the side of the diaphragm 13 facing away from the liquid chamber 14 is permanently exposed to atmospheric pressure.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The embodiments of the invention in which an exclusive property or privilege is claimed are defined as follows:

1. Liquid cooling system for an internal combustion engine, in which cooling liquid is circulated in a closed circuit from an engine block with a cooling jacket, through a radiator, and which has an expansion device for equalizing variations in volume arising as a result of thermal expansion, characterized in that the expansion device is formed separate from the closed circuit between the engine block and radiator exclusively by an expansion tank mounted directly on the engine block, the tank having a liquid chamber permanently communicating with the cooling liquid at the cooling jacket and bounded by a flexible diaphragm separate from the closed circuit between the engine block and radiator.

2. Liquid cooling system according to claim 1, characterized in that the expansion tank is hemispherical and the diaphragm is mounted in sealing relationship between the heispherical body and a circular bottom, and the liquid chamber is provided between the diaphragm and the bottom.

3. Liquid cooling system according to claim 2, characterized in that the chamber between the diaphragm and the hemispherical body has an aperture connecting it to the atmosphere.

4. Liquid cooling system according to any of the preceding claims, further characterized in that at the highest point of the radiator there is provided a filler neck with a cap comprising a vacuum valve and a pressure relief valve.

* * * * *